United States Patent [19]

Monvoisin

[11] 4,240,343

[45] Dec. 23, 1980

[54] AUTOMATIC MACHINE FOR SERIGRAPHIC PRINTING

[75] Inventor: Jacques Monvoisin, Paris, France

[73] Assignee: Tecal S.A.R.L., France

[21] Appl. No.: 35,133

[22] Filed: May 1, 1979

Related U.S. Application Data

[63] Continuation-in-part of Ser. No. 850,506, Oct. 11, 1977, abandoned.

[30] Foreign Application Priority Data

Nov. 15, 1976 [FR] France ..... 76 34261

[51] Int. Cl.[3] ..... B41F 15/08; B41F 15/30; B41F 15/42

[52] U.S. Cl. ..... 101/38 R; 101/123; 101/124; 101/126

[58] Field of Search ..... 101/38 R, 38 A, 4, 123, 101/126, 129, 114, 115, 124, 35

[56] References Cited

U.S. PATENT DOCUMENTS

| | | | |
|---|---|---|---|
| 3,109,365 | 11/1963 | Karlyn | 101/124 |
| 3,659,523 | 5/1972 | Olsen | 101/123 X |
| 3,780,652 | 12/1973 | Black | 101/126 X |
| 3,805,699 | 4/1974 | Mallofre | 101/126 X |
| 3,886,864 | 6/1975 | Larsson | 101/126 |

*Primary Examiner*—J. Reed Fisher
*Attorney, Agent, or Firm*—William A. Drucker

[57] ABSTRACT

The machine for serigraphic printing on planar or circular objects is of the type comprising a support block having a device for holding the object to be printed and a printing screen above which is vertically movable ink squeegee is suspended. The screen and squeegee undergo a relative movement of reciprocating translation. The machine comprises an adjustable device for cyclically limiting the reciprocating travel of the screen relative to the squeegee or vice-versa. The adjustable device acts alternately on devices for controlling, lowering or raising the squeegee relative to the screen or vice versa. The adjustable device is moreover coupled to a device for withdrawing the support block. The support block is provided with an ejector of the objects mounted on the support block.

4 Claims, 6 Drawing Figures

AUTOMATIC MACHINE FOR SERIGRAPHIC PRINTING

This application is a continuation-in-part of U.S. patent application Ser. No. 850,506 filed Oct. 11, 1977, now abandoned, by the same applicant.

The invention relates to an automatic machine for serigraphic printing on planar or circular objects such as packs or packaging, for example jars, flasks, bottles, boxes or the like.

Such machines for serigraphy are generally constituted by a stand supporting a screen of cloth which is fed with printing ink, said screen or stencil cooperating with a rubber blade or squeegee which makes the ink pass through the screen in the pervious zones thereof so that it is deposited in the form of a certain graphism on the object to be printed.

This squeegee is usually movable in reciprocating translation relative to the screen, although the contrary is possible, depending on the type of object that must be printed. This type of machine is usually equipped with very sophisticated supply, control and programming means so that the machine is heavy, space-consuming and expensive, the maintenance of which requires frequent inspections on the part of specialist.

An object of the invention is to provide professionals of serigraphy with a machine which is automatic and yet much less complicated in design than known machines and employs simple means of high technical reliability. Consequently, the machine according to the invention is light, small and easy to maintain.

According to the invention there is consequently provided an automatic machine for serigraphic printing on planar or circular objects, of the type comprising a support block, having means for holding the object to be printed in position, a printing screen above which is suspended a vertically movable ink squeegee, said screen and squeegee having a relative reciprocating movement of translation imparted thereto, wherein there are provided adjustable means for cyclically limiting the reciprocating travel of the screen relative to the squeegee or vice versa, said adjustable means acting alternately on means controlling the lowering or the raising of the squeegee relative to the screen or vice versa, said adjustable means being coupled with means for withdrawing the support block, the latter being provided with an object ejector controlled by the displacement of the support block.

According to a preferred embodiment, the screen is mounted to be movable in reciprocating translation relative to the ink squeegee, the adjustable means comprising stops which are held stationary in any relative positions on a slideway integral with the screen, said stops acting alternately on a finger member integral with a cam carried by a fork which is angularly movable about a vertical axis, said cam comprising an inclined ramp which periodically raises a raising arm to which the ink squeegee is secured.

According to a feature of the invention, the stops are constituted by two finger members perpendicular to the slideway on which they are held stationary, said finger members being contained in a plane which is perpendicular to that through which the finger member integral with the cam passes, the distance between the two stops depending on the length of the zone to be printed on the flat object or on the development of the circular object.

A machine according to the invention is shown by way of a non-limitative example in the accompanying drawings in which.

Figure 1:
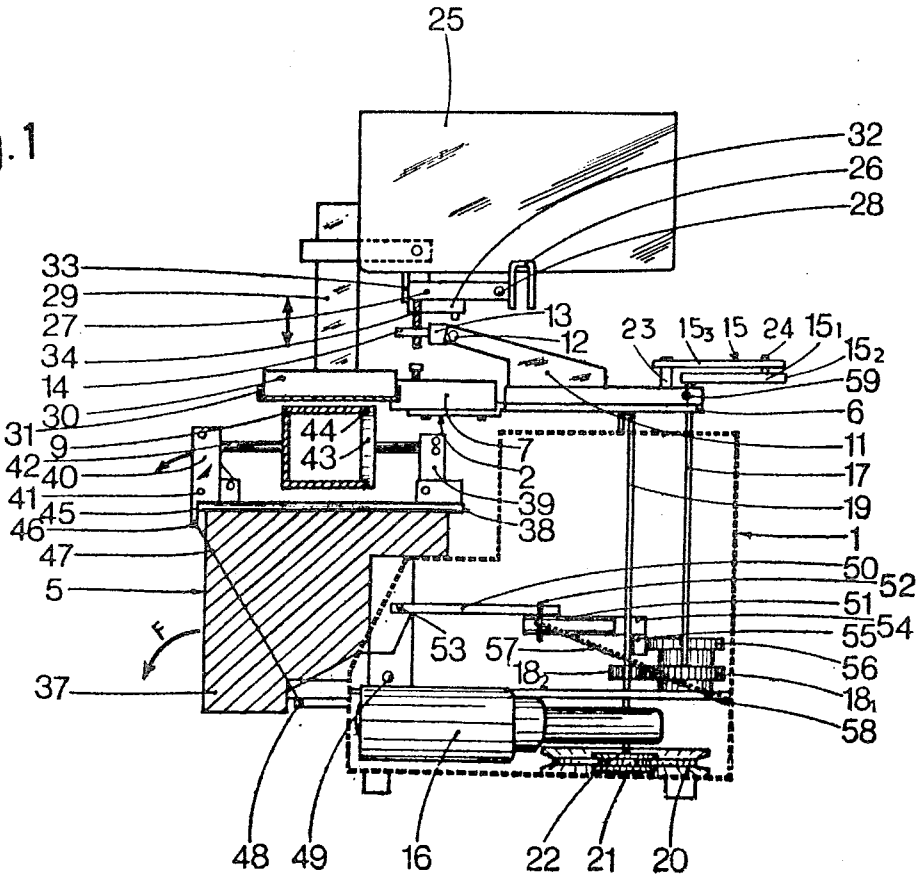
FIG. 1 is a front elevational view of the machine after the covering housing has been removed.

The machine according to the invention illustrated in FIGS. 1 to 6 comprises a frame or stand generally designated by the reference 1, a screen carrier 2 (FIGS. 1 and 3) in which the screen 3 proper is held stationary, a squeegee holder 4 and a support block 5 for maintaining the objects in facing relation to the printing screen.

The stand 1 is in the form of a box-like structure covered with a metal housing which has been partly removed in FIG. 1 in order to render the drawing more clear. Inside the housing are housed the control and transmission means for controlling the block 5 supporting the objects and for controlling the screen 3 or the squeegee holder 4. Outside the housing, there is seen the support block 5, located substantially on the median transverse axis of the machine (FIG. 2), the squeegee holder 4 and the screen support 2. The screen support 2 comprises a plate 6 on which are fixed two parallel U-section members 7, the latter being spaced apart and in facing relation to each other (FIGS. 2 and 3) and receiving the lateral edges of the screen-carrying frame 8; the screen-carrying frame 8 is held stationary in the slideways formed by the section members 7 by screws (not shown). In the considered embodiment, it is the screen-carrier which is movable in reciprocating translation relative to the squeegee since the object 9 to be printed is of circular shape. However, the opposite arrangement is perfectly possible, for example when the object to be printed is of planar shape. The ensuing description consequently implicitly covers these two possibilities. The whole of the screen support 2, or moving unit, is moved in reciprocating translation on a slideway bar 10 which extends horizontally and is fixed on the two lateral side walls of the frame 1. This moving unit comprises, in addition to the two section members 7 secured to the support plate 6, two small lateral side walls 11 for fixing a guide rod 12 on which latter are held stationary in any relative positions two stops 13 which are in the form of cubical blocks through which an orifice extends. Each of the blocks is slidable on the guide rod 12 and is held stationary in the chosen position by a lock screw. These stops 13 each comprise a finger member 14 which is best shown in FIG. 1, these finger members being horizontal but perpendicular to the guide rod 12 along which they are movable.

This moving unit is moved in reciprocating translation by a crank and link assembly 15 coupled to an electric motor 16. The crank $\mathbf{15}_1$ is integral by its end $\mathbf{15}_2$ with a lay shaft 17 on which a gear wheel $\mathbf{18}_1$ is fixed, the teeth of this gear wheel being in mesh with those of another gear wheel $\mathbf{18}_2$ which is fixed on a secondary shaft 19 at the lower end of which a grooved pulley 20 is fixed in alignment with a smaller pulley of the same type 21 which is fixed to the primary shaft 22 or output shaft of the motor 16. The transmission between the primary shaft and the secondary shaft is through a belt. The link $15_3$ of the crank and link assembly has its rear end connected to the moving unit, in particular to the plate 6 supporting the screen support 2, by a pin 23, the crank and link being pivotally mounted at 24. The displacement of the moving unit of the screen support is set as a function of the length of the zone to be printed (when it is planar) or of the part of the perimeter of the circular object which must receive the print. Such a setting is preferably obtained by providing a crank $15_1$ of adjustable length as illustrated on FIG. 3. Once this has been done, the spacing of the two stops 13 is adjusted for corresponding to the travel of the screen carrier.

The squeegee holder 4 is formed by a small independent housing 25 fixed to a longitudinal member 26. This housing supports a raising arm 27 mounted to pivot about a pin 28 from which is suspended a second arm 29 to which is fixed the blade holder 30 of the squeegee or blade 31. Pivotally mounted under the housing 25 is a stirrup or U-member 32 (FIGS. 4 and 5) to which a cam 33 is fixed, this stirrup comprising a finger member 34 which is located in the path of, but in a plane perpendicular to the path of, the finger members 14 of the stops 13. This stirrup is angularly movable on a pin 35 (FIG. 4), and periodically displaced in one direction or the other by the action of the finger members 14 of the stops 13 which alternately engage its respective finger member 34. The displacement of this stirrup has for effect to periodically bring the cam 33 which it supports in contact with the raising arm 27 (FIGS. 4 and 5) so that the ramp 36 of this cam raises it and consequently drives the squeegee holder which is integral therewith. The object-support block 5 comprises a parallel-sided assembly 37 which supports a detachable table 38 on which are fixed two section members 39 and 40 which are in facing relation to each other, the member 39 being fixed whereas the member 40 is pivotally mounted on a pin 41 so as to be capable of swinging rearwardly away from the position shown in FIG. 1. Each of the two members 39 and 40 carries a centering pin 42, the pin integral with the member 39 being assembled with a centering means 43 which may be a disc or a cross-member. This centering means comprises a recess 44 in which is fitted the periphery of the object 9 to be printed in the case where the latter is of circular shape. The pivotal section member 40 is downwardly extended by an ear 45 provided with an orifice 46 for the hooking or a connecting rod 47 whose other end is hooked at 48 to a fixed part of the frame 1.

This support block is pivotally mounted on a pin 49 so as to be rearwardly and downwardly swingable (arrow F) in a pendular movement. The swinging of the support block is controlled by a linkage comprising two links 50 and 51 which are pivotable on a common pin 52, these links being respectively fixed to the support block at 53 and to the secondary shaft at 54. The link 51 comprises a roller 55 which rolls on the profile of a cam 56 (FIG. 4) which has a concave portion $56_1$ and two convex portions $56_2$ which respectively correspond to the raised position and the withdrawn position of the object support block. The joint pin 52 of the two links is connected to a return spring 57 attached to a fixed part of the frame at 58.

Figure 2:
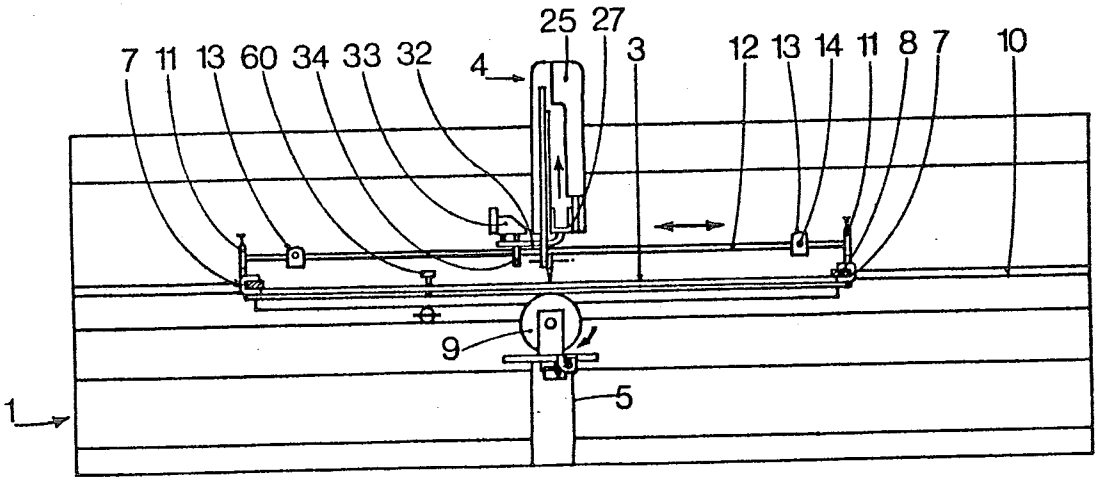
FIG. 2 is a side elevational view of the machine corresponding to the left side of FIG. 1.
Figure 6:
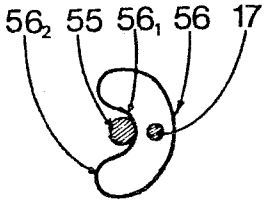
FIGS. 4 and 5 are side elevational views illustrating the raising motion of the squeegee and FIG. 6 is a plan view of a cam controlling the withdrawal of the object support block.
Figure 3:
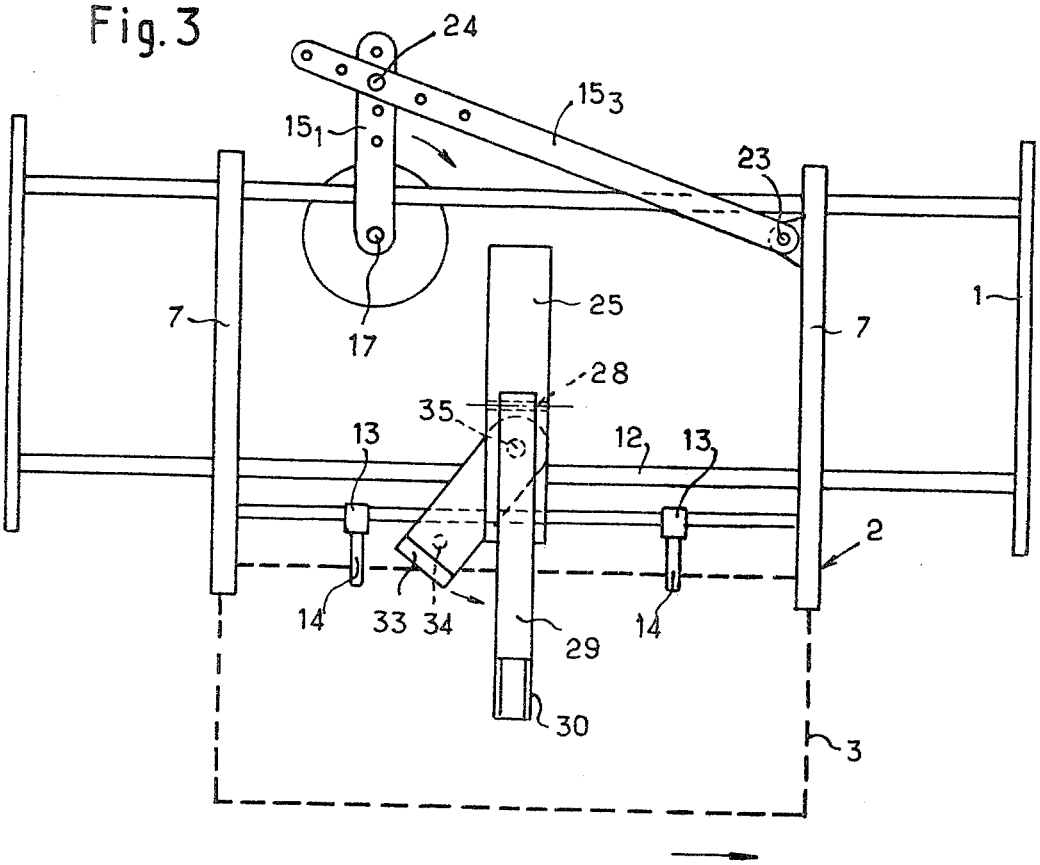
FIG. 3 is a top view of the machine, of which the object support block has been removed.
Figure 4:
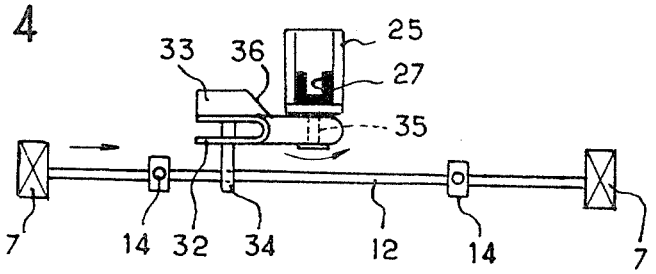
Figure 5:
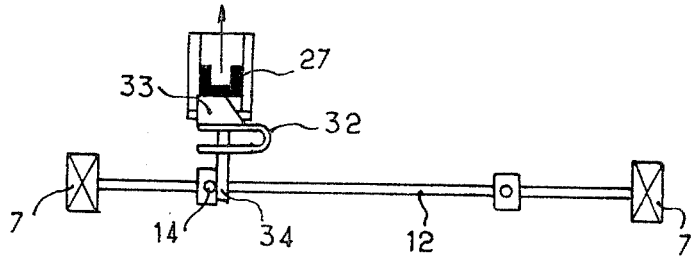

The machine operates in the following manner:

Starting with the machine in the stationary condition with a blank object ready for printing secured to the support block 5 by the centering pins 42, the parts of the machine have the following positions:

the raising arm 27 is in the lower position so that the squeegee blade 31 is in contact with the printing screen 3, the cam 33 being in the withdrawn position shown in FIG. 2;

the screen support, that is to say the moving unit, is at the end of its travel (on the left side of FIG. 2) the finger member 14 of the stop 13 on the right side of FIG. 2 being in contact with the finger member 34 integral with the cam 33;

the support block is in the upper position as shown in FIG. 1, the roller 55 of the linkage 50–51 being located in the bottom of the concave portion $56_1$ of the cam 56 (FIG. 4) and the return spring 57 of the linkage being in the extended state.

When the motor 16 is started up, it drives in rotation the primary shaft 22, the pulley 21, then the pulley 20, the secondary shaft 19 and finally the lay shaft 17 by the action of the two gear wheels $18_1$–$18_2$, so that the cam 56 fixed on the lay shaft is rotated. The rotation of the lay shaft also causes the displacement of the crank and link assembly $15_1$–$15_3$ and this drives in translation the moving unit supporting the printing screen 3. During the transfer of the moving unit, the squeegee 31 in contact with the screen 3 causes the ink disposed on the screen to pass through the pervious mesh of the cloth so that it prints the object 9, the latter being driven in rotation about itself by drive means of known type connected to the motor 16. The rotational speed of the object depends on the portion of the perimeter to be printed, on the object and on the type of graphism to be produced.

Up to this stage, the linkage 50–51 has not been actuated, since the roller 55 has not left the concave portion $56_1$ of the cam 56.

When the finger member 14 of the stop 13 (located on the left side of FIG. 2) comes in contact with the finger member 34 of the cam 33 controlling the raising of the raising arm 27, the printing operation has finished and the following functions have merely for object to re-arm the machine and to substitute another blank unprinted object for the printed object.

At this stage, with the motor still running, the moving unit continues its displacement toward the right in sliding along the slideway bar 10 and this brings the ramp 36 of the cam 33 under the raising arm 27 which, in sliding on this ramp, moves angularly upwardly about its pivot point or pin 28. This raising movement stops when the raising arm is located on the flat portion $33_1$ of the cam 33. At this moment, the squeegee 30 is spaced away from the screen 3. Simultaneously with this period of operation, the roller 55 leaves the concave portion 56 of the cam 55 so that the rising thereof on the convex portion $56_2$ of the cam exerts a thrust on the linkage 50–51 and causes the support block 5 to pivot angularly about the pin 49 and swing rearwardly and downwardly. The withdrawal of the support block had for effect to swing the section member 40 which, under the effect of the pull exerted by the rod 47, pivots rearwardly on the pin 41 and thereby releases the printed object 9. The operator can consequently place manually a new object to be printed on the support block 5.

As the cycle continues, the movement in rotation of the crank and link assembly is converted into a linear movement which causes the moving unit to move in the opposite direction to the original direction.

This return of the moving unit to its initial position has solely for object to re-arm the machine, since the squeegee 31 is not in contact with the screen 3 and the printing is consequently temporarily interrupted. During this return, the support block 5 is returned to the upper position, that is to say to the operating position, by the action of the return spring 57 which acts on the linkage 50–51 when the roller 55 resumes its position in the concave portion $56_1$ of the cam 56. The return of the moving unit continues until the finger member 14 of the stop 13, located in the right part of FIG. 2, comes in contact with the finger member 34 of the cam 33, causing the stirrup 32 which supports it to pivot on the pin 35 and withdraw the cam 33 until it has left the raising arm 27. As the raising arm is no longer biased upwardly, it is returned by the action of a return spring (not shown) to a lower position until the squeegee 31 resumes contact with the cloth of the printing screen 3. At this stage, new printing recommences and so on.

It will be understood that this automatic cycle of operation is suitable for both circular and planar objects. In the latter case, the screen and the screen carrier are fixed to the stand 1, whereas the housing 25 of the squeegee holder is movable in reciprocating translation on longitudinal member 26 and connected to link $15_3$. In this embodiment, finger members 14 are stationary, while finger member 34, which is connected to housing 25, is movable in reciprocating translation.

The moving unit comprising the screen carrier is pivotally mounted on a longitudinal pin 59 so as to be capable of being adjusted in height relative to the squeegee. This adjustment is achieved by means of a screw 60 supported on the frame.

The advantage of this machine is that it is light, portable and simple in operation with no need for sophisticated means requiring frequent adjustments or servicing.

It must be understood that the invention is not intended to be limited to the embodiment described hereinbefore as other embodiments may be envisaged without departing from the scope of the invention as defined in the appended claims.

I claim:

1. An automatic machine for serigraphic printing on circular articles, said machine comprising in combination: a frame structure; a slide-bar longitudinally extending in the said frame structure; screen support means mounted for reciprocating translation on said slide-bar; means for reciprocatingly moving said screen support means; a printing screen located on said screen support means; a squeegee above said screen; first means for lowering and lifting said squeegee above said screen into and out of contact, respectively, with the upper side of said screen; an article holder arranged below said screen and second means for lifting and lowering said holder for bringing said article into and out of contact, respectively, with the underside of said screen; a guide rod integrally mounted on said screen support means parallel to the said slide-bar; and first and second support members adjustably positioned on said guide rod, first and second fingers respectively mounted integral with said first and second support members, said first and second fingers being parallel to the screen and at right angles with the guide rod, said means for reciprocatingly moving said screen support means comprising motor means having an output shaft, crank and link means connected to the screen support means and gear means connecting the said output shaft to said crank and link means, said first means including an oscillating arm having one end connected to said squeegee and another end where the said oscillating arm is pivotally mounted with respect to the frame structure, said first means further including a pin fixedly mounted on the frame structure at right angles with the screen, a supporting member pivotally mounted on said pin, a camming member and a third finger being secured to said supporting member, said third finger being arranged parallel to said pin and across said guide rod for alternate engagement of said third finger with the first and second fingers, the said camming member being located for engaging the said oscillating arm and arranged for raising the said oscillating arm when the first finger is engaged by the third finger and for lowering the said oscillating arm when the second finger is engaged by the third finger.

2. An automatic machine for serigraphic printing on planar articles, said machine comprising in combination: a frame structure; a slide-bar longitudinally extending in the said frame structure; a squeegee mounted for reciprocating translation on said slide bar; means for reciprocatingly moving said squeegee; a printing screen fixedly mounted on said frame structure below said squeegee; first means for lowering and lifting said squeegee above said screen into and out of contact respectively, with the upper side of said screen; an article holder arranged below said screen and second means for lifting and lowering said holder for bringing said article into and out of contact, respectively, with the under side of said screen; a guide rod integrally mounted on said frame structure parallel to the said slide-bar and first and second support members adjustably positioned on said guide rod, first and second fingers respectively mounted integral with said first and second support members, said first and second fingers being parallel to the screen and at right angles with the guide rod, said means for reciprocatingly moving said squeegee comprising motor means having an output shaft, crank and link means connected to the squeegee and gear means connecting the said output shaft to said crank and link means, said first means including an oscillating arm having one end connected to said squeegee and another end where the said oscillating arm is pivotally mounted with respect to the frame structure, said first means further including a pin fixedly connected to the squeegee at right angles with the screen, a supporting member pivotally mounted on said pin, a camming member and a third finger being secured to said supporting member, said third finger being arranged parallel to said pin and across said guide rod for alternate engagement of said third finger with the first and second fingers, the said camming member being located for engaging the said oscillating arm and arranged for raising the said oscillating arm when the first finger is engaged by the third finger and for lowering the said oscillating arm when the second finger is engaged by the third finger.

3. An automatic machine as claimed in claim 1, wherein said article holder is pivotally mounted in said frame structure and said second means comprise first and second pivotally interconnected links, the first link being secured to the article holder and means for mechanically linking the second link to the said output shaft, said second means further comprising a roller rotatably mounted on the second link and a cam drivingly connected to the output shaft and cooperating with said roller.

4. An automatic machine as claimed in claim 2, wherein said article holder is pivotally mounted in said frame structure and said second means comprise first and second pivotally interconnected links, the first link being secured to the article holder and means for mechanically linking the second link to the said output shaft, said second means further comprising a roller rotatably mounted on the second link and a cam drivingly connected to the output shaft and cooperating with said roller.

* * * * *